US008909089B2

(12) United States Patent
Kim

(10) Patent No.: US 8,909,089 B2
(45) Date of Patent: Dec. 9, 2014

(54) IMAGE FORMING APPARATUS WITH DRIVE DEVICE TO MOVE CLEANING UNIT

(75) Inventor: Hyun Soo Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 289 days.

(21) Appl. No.: 13/271,289

(22) Filed: Oct. 12, 2011

(65) Prior Publication Data

US 2012/0099886 A1 Apr. 26, 2012

(30) Foreign Application Priority Data

Oct. 21, 2010 (KR) ..... 10-2010-0102876

(51) Int. Cl.
*G03G 21/00* (2006.01)
*G03G 21/18* (2006.01)
*G03G 15/04* (2006.01)

(52) U.S. Cl.
CPC ..... *G03G 21/1825* (2013.01); *G03G 15/04045* (2013.01); *G03G 2221/1651* (2013.01)
USPC ..... 399/98

(58) Field of Classification Search
USPC ..... 399/98, 110, 111, 112
See application file for complete search history.

(56) References Cited

U.S. PATENT DOCUMENTS

2008/0286001 A1* 11/2008 Matsumoto et al. ..... 399/112
2009/0269102 A1* 10/2009 Kaneko et al. ..... 399/123
2011/0286760 A1* 11/2011 Tidrick ..... 399/98

FOREIGN PATENT DOCUMENTS

JP 2006267137 A * 10/2006
KR 2008007028 A * 1/2008

* cited by examiner

*Primary Examiner* — Quana M Grainger
(74) *Attorney, Agent, or Firm* — Staas & Halsey LLP

(57) ABSTRACT

An image forming apparatus includes a cleaning unit to cover/uncover and/or clean a transparent window of a light scanning unit in linkage with operation of a drive device that causes a photoconductor and a developing roller to come into contact with each other or to be spaced apart from each other, thereby assuring enhanced reliability in cleaning operation.

37 Claims, 10 Drawing Sheets

IMAGE FORMING APPARATUS WITH DRIVE DEVICE TO MOVE CLEANING UNIT

CROSS-REFERENCE TO RELATED APPLICATIONS

This application claims the benefit of priority under 35 U.S.C. §119 to Korean Patent Application No. 10-2010-0102876, filed on Oct. 21, 2010 in the Korean Intellectual Property Office, the disclosure of which is incorporated herein by reference in its entirety.

BACKGROUND OF THE INVENTION

1. Field of the Invention

The present general inventive concept generally relates to an image forming apparatus, and more particularly, to an image forming apparatus having a light scanning unit provided with a member to clean a transparent window through which light is transmitted.

2. Description of the Related Art

An image forming apparatus is an apparatus designed to form an image on a printing medium based on an input image signal. Examples of image forming apparatuses include printers, copiers, fax machines, and devices combining functions thereof.

In an image forming apparatus, a laser beam is irradiated to a uniformly charged photoconductor, based on a predetermined control signal, to form an electrostatic latent image. A visible image obtained by developing the electrostatic latent image is transferred to a printing medium, completing formation of an image.

A light scanning unit to irradiate a laser beam is hermetically sealed to prevent invasion of impurities that are likely present on a path between a light source and a photoconductor. The laser beam irradiated from the light source received in the light scanning unit is transmitted to the photoconductor through a transparent window.

The image forming apparatus contains various impurities within a main body thereof. Therefore, the transparent window can become stained with such impurities, causing errors in the image forming operation.

SUMMARY OF THE INVENTION

Therefore, it is an aspect of the present general inventive concept to provide an image forming apparatus to assure effective cleaning of a transparent window of a light scanning unit.

Aspects and utilities of the present general inventive concept will be set forth in part in the description which follows and, in part, will be obvious from the description, or may be learned by practice of the general inventive concept.

The foregoing and/or other features and utilities of the present general inventive concept may be realized by an image forming apparatus including a developing unit including a photoconductor and a developing roller movably installed between a first position to come into contact with the photoconductor and a second position to be spaced apart from the photoconductor, a light scanning unit including a light source and a transparent window through which light emitted from the light source is transmitted, and a cleaning unit including a cleaning cover movably installed to uncover and cover the transparent window in linkage with movement of the developing roller between the first position and the second position.

The cleaning cover may uncover the transparent window when the developing roller is at the first position and may cover the transparent window when the developing roller is at the second position.

The image forming apparatus may further include a drive device to move the developing roller, and the cleaning cover may be operated in linkage with the drive device.

The drive device may include a drive plate to be rectilinearly reciprocated by a drive source, and during movement of the drive plate, the developing roller and the cleaning cover may be operated in linkage with operation of the drive plate.

A cleaning sheet to clean the transparent window may be attached to the cleaning cover.

The drive device may further include a drive gear to be rotated upon receiving power from the drive source and a power converter to convert rotational motion of the drive gear to rectilinear motion of the drive plate.

The power converter may include a rotating shaft, a supporting arm extending in a given direction from the rotating shaft so as to receive rotational force of the drive gear, and an operating arm extending in an opposite direction from the rotating shaft so as to press the drive plate.

The power converter may further include a torsion spring fitted on the rotating shaft so as to return the operating arm to an original position.

The cleaning unit may include a first link having one end rotatably coupled to a first end of the cleaning cover and a second link having one end rotatably coupled to a second end of the cleaning cover, and a cleaning plate to which a center portion of the first link is rotatably coupled.

The cleaning unit may further include a cleaning actuator rotatably coupled to the cleaning plate so as to rotate the first link in linkage with operation of the drive plate.

The developing unit may include a first housing to support the photoconductor, a second housing to support the developing roller, a rotating shaft to rotatably couple the first and second housings to each other so as to enable movement of the developing roller between the first position and the second position, and an elastic member to elastically support the first and second housings so as to keep the developing roller at the first position.

The developing unit may further include a retainer protrusion configured to contact the drive plate to move the developing roller to the second position in linkage with operation of the drive plate.

The drive plate may include a pressure protrusion to press the retainer protrusion.

The developing unit may include first to fourth developing units in which magenta, cyan, yellow and black toners are received respectively, the light scanning unit may include first to fourth transparent windows through which light is transmitted toward the photoconductor of each of the first to fourth developing units, and the cleaning cover may include first to fourth cleaning covers to uncover and cover the first to fourth transparent windows respectively.

The first to fourth cleaning covers may be individually operated according to operation of each developing roller that feeds toner to the photoconductor of each of the first to fourth developing units.

The fourth cleaning cover to uncover and cover the fourth transparent window may be movable independently of the first to third cleaning covers.

The image forming apparatus may further include a first drive plate to move the first to third cleaning covers, and a second drive plate to move the fourth cleaning cover.

The developing unit may include a first housing to support the photoconductor and a second housing to support the developing roller, the first housing and the second housing may be rotatably coupled to each other, the image forming apparatus may further include a drive device to press and rotate the second housing so as to move the developing roller, and the cleaning cover may be installed to uncover and cover the transparent window in linkage with rotation of the second housing.

The cleaning unit may further include a first link having one end rotatably coupled to a first end of the cleaning cover and a second link having one end rotatably coupled to a second end of the cleaning cover, a cleaning plate to which the a center portion of the first link is rotatably coupled, and a cleaning actuator rotatably coupled to the cleaning plate so as to rotate the first link in linkage with rotation of the second housing, one end of the cleaning actuator being supported by the first link and the other end being supported by the second housing.

The foregoing and/or other features and utilities of the present general inventive concept may be realized by an image forming apparatus including at least one developing unit including a photoconductor and a developing roller to feed toner to the photoconductor so as to form a visible image, a first housing to support the photoconductor, a second housing to support the developing roller, a rotating shaft to rotatably couple the first housing and the second housing to each other such that the photoconductor and the developing roller are rotatable between a position in contact with each other and a position spaced apart from each other, and an elastic member to apply elastic force to bias the photoconductor and the developing roller into the position in contact with each other, a drive device to be reciprocated between a position to press at least one of the first and second housings and a position not pressing the first and second housings, and a cleaning unit including a housing having at least one transparent window through which light emitted from a light source received in the housing is transmitted to the photoconductor, and at least one cleaning cover movably installed between a first position to uncover the transparent window and a second position to cover the transparent window, wherein the cleaning cover is movably installed between the first position and the second position in linkage with reciprocation of the drive device.

A cleaning sheet may be attached to the cleaning cover to clean the transparent window.

The cleaning cover may uncover the transparent window when the photoconductor and the developing roller come into contact with each other, and may cover the transparent window when the photoconductor and the developing roller are spaced apart from each other.

The drive device may include a drive plate to be rectilinearly reciprocated by a drive source, and the cleaning unit may include a cleaning actuator to be rotated upon receiving power of the drive plate so as to move the cleaning cover.

At least one of the first and second housings may be provided with a retainer protrusion, which comes into contact with the drive plate when the drive plate is moved in a first direction, thereby acting to rotate at least one of the first and second housings upon receiving power of the drive plate, and is released from the drive plate when the drive plate is moved in a second direction opposite to the first direction.

The drive plate may be provided with a pressure protrusion to be caught and supported by the retainer protrusion when the drive plate is moved in the first direction.

The drive device may further include a drive gear to be rotated upon receiving power from the drive source, and a power converter to convert rotational motion of the drive gear to rectilinear motion of the drive plate.

The power converter may include a rotating shaft, a supporting arm extending in a given direction from the rotating shaft so as to receive rotational force of the drive gear, and an operating arm extending in an opposite direction from the rotating shaft so as to press the drive plate.

The power converter may further include a torsion spring fitted on the rotating shaft so as to return the operating arm to an original position.

The cleaning unit may include a cleaning plate to which the a center portion of the cleaning actuator is rotatably coupled, a first link having one end supported by the housing and the other end supported by a first end of the cleaning cover, and a second link centrally rotatably coupled to the cleaning plate, one end of the second link being supported by the a second end of the cleaning cover and the other end of the second link being supported by the cleaning actuator.

The at least one developing unit may include a plurality of developing units each including a corresponding photoconductor and a corresponding developing roller, the at least one transparent window may include a plurality of transparent windows provided at the housing to correspond to the photoconductor of each of the plurality of developing units, the at least one cleaning cover may include a plurality of cleaning covers corresponding to the plurality of transparent windows respectively, and the drive plate may include a first drive plate to move any one of the plurality of cleaning covers and a second drive plate to move the others of the plurality of cleaning covers.

The at least one developing unit may include a plurality of developing units each including a corresponding photoconductor and a corresponding developing roller, the at least one transparent window may include a plurality of transparent windows provided at the housing to correspond to the photoconductor of each of the plurality of developing units, the at least one cleaning cover may include a plurality of cleaning covers corresponding to the plurality of transparent windows respectively, and each of the plurality of cleaning covers may uncover or cover one corresponding transparent window in linkage with an operation to cause the developing roller and the photoconductor to rotate between the position in contact with each other and the position spaced apart from each other.

The foregoing and/or other features and utilities of the present general inventive concept may be realized by an image forming apparatus including a developing unit including a photoconductor and a developing roller to feed toner to the photoconductor so as to form a visible image, a first housing to support the photoconductor, a second housing to support the developing roller, a rotating shaft to rotatably couple the first housing and the second housing to each other such that the photoconductor and the developing roller are rotatable between a position in contact with each other and a position spaced apart from each other, and an elastic member to apply elastic force to bias the photoconductor and the developing roller to the position in contact with each other, a drive device to press the second housing so as to rotate the second housing about the rotating shaft, and a cleaning unit including a housing having a transparent window through which light emitted from a light source received in the housing is transmitted to the photoconductor, and a cleaning cover movably installed between a first position to uncover the transparent window and a second position to cover the transparent window, wherein the cleaning cover is movably installed between the first position and the second position in linkage with rotation of the second housing.

The cleaning unit may further include a first link having one end rotatably coupled to a first end of the cleaning cover and a second link having one end rotatably coupled to a second end of the cleaning cover, a cleaning plate to which a center portion of the first link is rotatably coupled, and a cleaning actuator rotatably coupled to the cleaning plate so as to rotate the first link in linkage with rotation of the second housing, one end Of the cleaning actuator being supported by the first link and the other end being supported by the second housing.

The foregoing and/or other features and utilities of the present general inventive concept may be realized by an image forming apparatus including a developing unit including a photoconductor and a developing roller, a light scanning unit including a light source and a transparent window through which light emitted from the light source is transmitted to the photoconductor, and a cleaning unit including a cleaning cover moveable between a first position to cover the transparent window and a second position to uncover the transparent window, wherein the cleaning cover includes a cleaning sheet attached to the cleaning cover such that the cleaning sheet slides across the transparent window to clean the transparent window when the cleaning cover moves from the first position to the second position.

The cleaning sheet may include a cotton flannel sheet.

The cleaning sheet may include a brush.

The cleaning sheet may have a length that is substantially equal to a length of the transparent window.

BRIEF DESCRIPTION OF THE DRAWINGS

Exemplary embodiments of the present general inventive concept will be more clearly understood from the following detailed description taken in conjunction with the accompanying drawings in which.

DETAILED DESCRIPTION OF THE PREFERRED EMBODIMENTS

Figure 1:
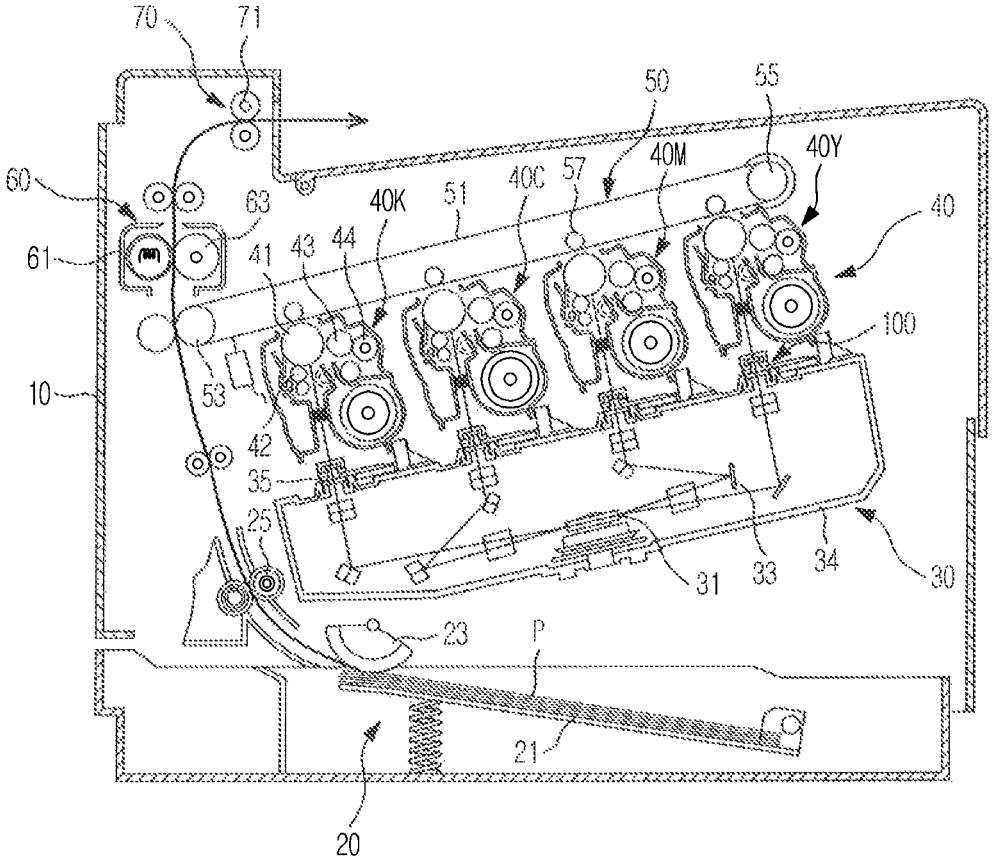
FIG. 1 is a sectional view schematically illustrating an entire configuration of an image forming apparatus according to an exemplary embodiment of the present general inventive concept.

Reference will now be made in detail to the embodiments of the present general inventive concept of an image forming apparatus, examples of which are illustrated in the accompanying drawings, wherein like reference numerals refer to like elements throughout. The embodiments are described below in order to explain the present general inventive concept by referring to the figures.

FIG. 1 is a sectional view schematically illustrating an entire configuration of the image forming apparatus according to an exemplary embodiment of the present general inventive concept.

As illustrated in FIG. 1, the image forming apparatus according to the exemplary embodiment may include a main body 10, a paper feeding unit 20, a light scanning unit 30, a developing unit 40, a transfer unit 50, a fusing unit 60, and a paper discharge unit 70.

The main body 10 defines an external appearance of the image forming apparatus and supports a variety of elements received therein.

The paper feeding unit 20 may include a cassette 21 in which printing media P is stored, a pickup roller 23 to pick up the printing media P stored in the cassette 21 one by one, and a delivery roller 25 to deliver each picked printing medium P toward the developing unit 40.

The developing unit 40 may include four developing units 40Y, 40M, 40C and 40K, in which different colors of toners, for example, yellow (Y), magenta (M), cyan (C), and black (K) toners are received respectively.

Each of the developing units 40Y, 40M, 40C and 40K may include a photoconductor 41, on a surface of which an electrostatic latent image is formed by the light scanning unit 30, a charging roller 42 to charge the photoconductor 41, a developing roller 43 to apply toner to the electrostatic latent image formed on the photoconductor 41 so as to form a visible image, and a feed roller 44 to supply the toner to the developing roller 43.

In the present exemplary embodiment, the developing unit 40 is configured in such a manner that the photoconductor 41 and the developing roller 43 come into contact with each other to develop the electrostatic latent image. To this end, the photoconductor 41 and the developing roller 43 are movable between a first position where they come into contact with each other and a second position where they are spaced apart from each other. This movement will be described later.

The light scanning unit 30 irradiates light corresponding to yellow, magenta, cyan and black image signals to the photoconductors 41 of the respective developing units 40Y, 40M, 40C and 40K.

The light scanning unit 30 may include a case 34, in which a light source (not shown) to emit light based on an image signal, a polygonal mirror 31 to deflect the light emitted from the light source to the photoconductor 41, and an optical lens 33 to focus the light reflected by the polygonal mirror 31 are received.

The case 34 may be provided with a transparent window 35 such that the light emitted from the light source is transmitted to the photoconductor 41 of each developing unit 40.

The transfer unit 50 may include a transfer belt 51 to perform circulation traveling in contact with the photoconductor 41 of each developing unit 40, a drive roller 53 to drive the transfer belt 51, a tension roller 55 to apply a constant tensile force to the transfer belt 51, and four rollers 57 to transfer a toner image developed on the photoconductor 41 of each developing unit 40 to the printing medium P.

The fusing unit 60 includes a heating roller 61 containing a heat source to heat the printing medium P to which the toner has been transferred, and a pressure roller 63 installed to face the heating roller 61 to maintain a constant fusing pressure between the heating roller 61 and the pressure roller 63.

The paper discharge unit 70 may include a plurality of discharge rollers 71 to discharge the printing medium P, on which the image has completely been formed, to the outside of the main body 10.

With the above-described configuration, as the printing medium P, picked up by the paper feeding unit 20, is delivered to the developing unit 40, a color image is transferred from the photoconductor 41 of each developing unit 40 to the printing medium P, and after the fusing unit 60 fuses the color image to the printing medium P, the paper discharge unit 70 discharges the printing medium P to the outside of the main body 10.

During the above-described operation of the image forming apparatus, the main body 10 may become contaminated with various impurities, such as toner dust or dirt introduced from the outside, and these impurities may be adhered to the transparent window 35 of the light scanning unit 30.

The image forming apparatus of the present exemplary embodiment may include a cleaning unit 100 to prevent impurities from being adhered to the transparent window 35 of the light scanning unit 30 or remove the adhered impurities.

Figure 2:
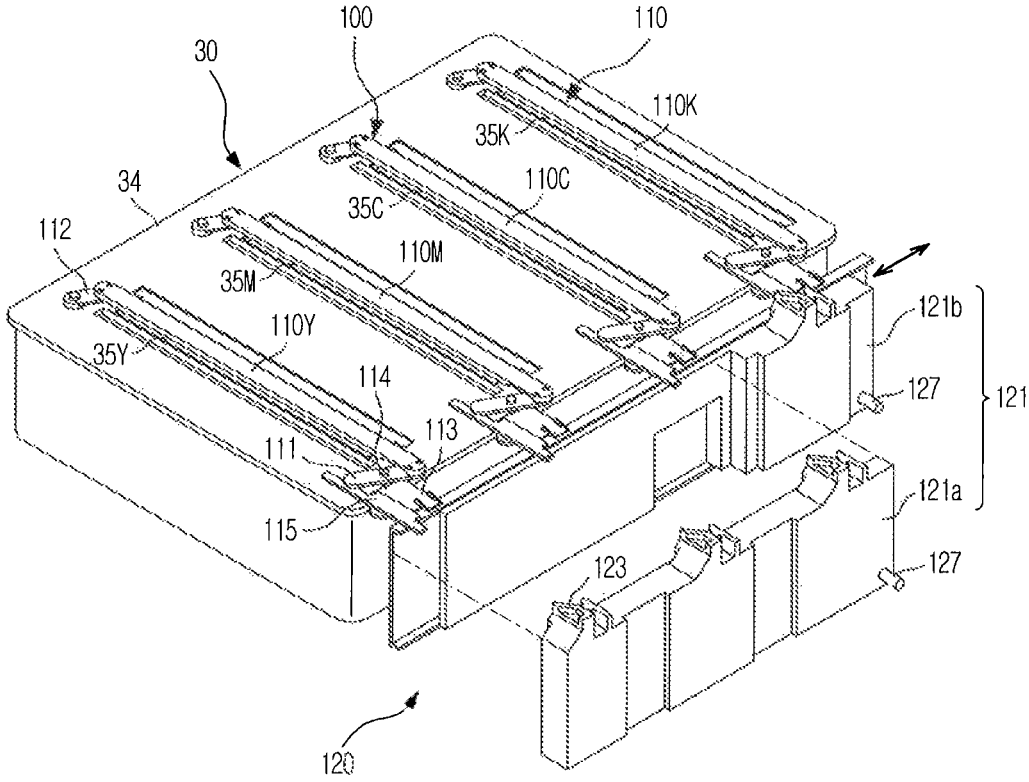
FIG. 2 is a perspective view illustrating a light scanning unit according to an exemplary embodiment of the present general inventive concept.
Figure 3:
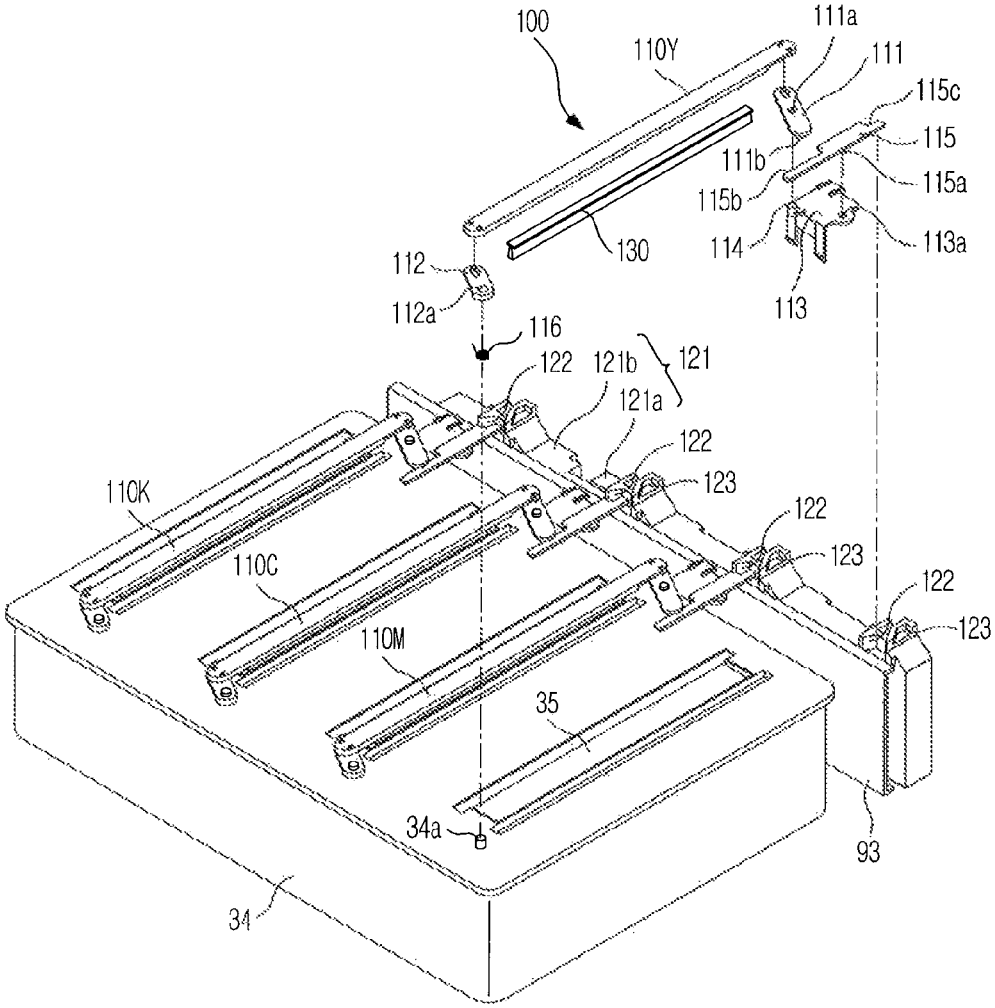
FIG. 3 is an exploded perspective view illustrating a cleaning unit coupled to the light scanning unit according to an exemplary embodiment of the present general inventive concept.

FIG. 2 is a perspective view illustrating the light scanning unit according to an exemplary embodiment of the present general inventive concept, and FIG. 3 is an exploded perspective view illustrating the cleaning unit coupled to the light scanning unit according to the exemplary embodiment.

As illustrated in FIGS. 2 and 3, the light scanning unit 30 may include the case 34 in which the light source to emit light is received, and a transparent window 35, through which the light emitted from the light source is transmitted, may be provided at an upper surface of the case 34.

The light scanning unit 30 may include four transparent windows 35Y, 35M, 35C and 35K corresponding to the photoconductors 41 of the developing units 40Y, 40M, 40C and 40K.

The transparent window 35 is elongated in a width direction of the case 34. The cleaning unit 100 may be provided on the transparent window 35 to cover or uncover the transparent window 35.

The cleaning unit 100 may include a cleaning cover 110 having a shape corresponding to the transparent window 35. The cleaning cover 110 is installed to be movable between a first position to uncover the transparent window 35 and a second position to cover the transparent window 35.

The cleaning cover 110 functions to cover the transparent window 35 when the light scanning unit 30 is not in operation, preventing the transparent window 35 from being stained with impurities.

The cleaning cover 110 may be moved, in linkage with operation of the developing unit 40, to a position for covering or uncovering the transparent window 35. This will be described later.

The cleaning unit 100 includes a drive device 120 to move the cleaning cover 110.

The drive device 120 may also serve as a power source to move both the developing roller 43 of each developing unit 40 as well as the cleaning cover 110. A configuration to move the developing roller 43 will be described later.

Figure 6:
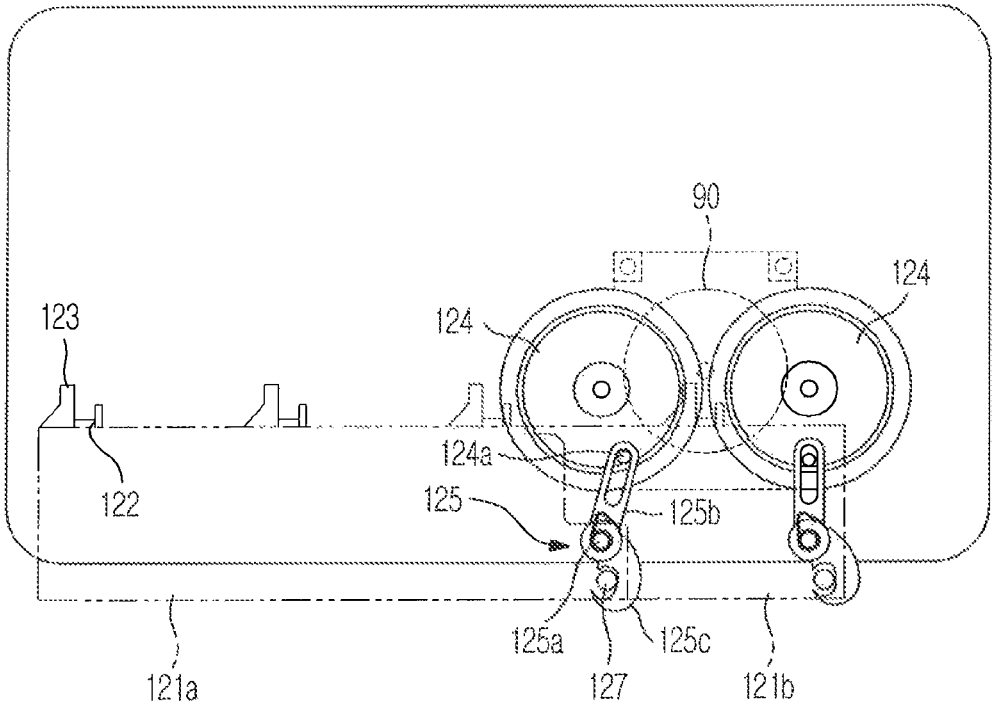

The drive device 120 may include a drive plate 121, which is rectilinearly reciprocated by a drive source 90 such as a motor (see FIG. 6).

The drive plate 121 provides power required to move the cleaning cover 110 and may be equal in number to the cleaning cover 110.

In the present exemplary embodiment, the drive plate 121 may include a first drive plate 121*a* and a second drive plate 121*b*. The first drive plate 121*a* functions to move cleaning covers 110Y, 110M and 110C to cover or uncover transparent windows 35Y, 35M and 350 through which light is transmitted to the respective photoconductors 41 of the developing units 40Y, 40M and 40C in which yellow (Y), magenta (M) and cyan (C) toners are received. The second drive plate 121*b* functions to move a cleaning cover 110K to cover or uncover a transparent window 35K, through which light is transmitted to the photoconductor 41 of the developing unit 40K in which black (K) toner is received.

The first drive plate 121*a* is operated in linkage with the developing units 40Y, 40M and 40C to uncover the transparent windows 35Y, 35M and 35C during color image printing.

The second drive plate 121*b* is operated in linkage with the developing unit 40K to uncover only the transparent window 35K through which light is transmitted to the black developing unit 40K.

A link mechanism to operate cleaning cover 110Y to cover or uncover the transparent window 35 according to an exemplary embodiment of the present general inventive concept is illustrated in FIG. 3. To move the cleaning cover 110Y to cover or uncover the transparent window 35 upon receiving power from the drive plate 121*a*, the cleaning unit 100 may include a first link 111 and a second link 112 provided at both ends of the cleaning cover 110Y, a cleaning plate 113 having a link rotating shaft 114 to which the center of the first link 111 is rotatably coupled, and a cleaning actuator 115 centrally rotatably coupled to the cleaning plate 113 to rotate the first link 111 in linkage with operation of the drive plate 121*a*.

One end of the first link 111 is rotatably connected to one end of the cleaning cover 110Y and the other end of the first link 111 is provided with a supporting protrusion 111*b* supported on the cleaning actuator 115. The first link 111 is centrally provided with a rotating hole 111*a* for insertion of the link rotating shaft 114.

One end of the second link 112 is rotatably connected to the other end of the cleaning cover 110Y and the other end of the second link 112 is provided with a rotating hole 112*a* for insertion of a rotating shaft 34*a* provided at the case 34. A torsion spring 116 may be fitted on the rotating shaft 34*a* to elastically support the second link 112 so as to allow the second link 112 to be easily returned from a rotated position to an original position thereof.

The cleaning plate 113 takes the form of a flat plate, both ends of which are supported by the case 34 and a securing plate 93 respectively. The cleaning plate 113 has an actuator rotating hole 113*a*.

The cleaning actuator 115 has a bar-like shape and may be centrally provided with a shaft 115*a* inserted in the rotating hole 113*a* of the cleaning plate 113.

The cleaning actuator 115 is connected to the cleaning plate 113 so as to be rotatable about the shaft 115*a*. The cleaning actuator 115 has one end 115*b* supported by the supporting protrusion 111*b* of the first link 111 and the other end 115*c* supported by the drive plate 121*a*.

The drive plate 121 is provided with an actuator nip 122. The actuator nip 122 serves to press the other end 115*c* of the cleaning actuator 115 so as to rotate the cleaning actuator 115.

The actuator nip 122 provided at the drive plate 121 is equal in number to the cleaning cover 110 functioning to cover or uncover the transparent window 35.

Specifically, in the case where the first drive plate 121*a* is used to move the three cleaning covers 110Y, 110M and 110C, the first drive plate 121*a* may be provided with three actuator nips 122 such that the actuator nips 122 come into contact with the cleaning actuators 115 in a one to one ratio.

Although the present embodiment exemplifies a link mechanism to operate the cleaning cover 110 upon receiving power from the drive plate 121, any other power transmission mechanism (racks, links, gears, etc.) may be utilized to convert rectilinear reciprocating motion of the drive plate 121 into covering or uncovering operation of the cleaning cover 110.

Hereinafter, the drive device 120 to rectilinearly reciprocate the drive plate 121 will be described in detail by way of example.

Figure 4:
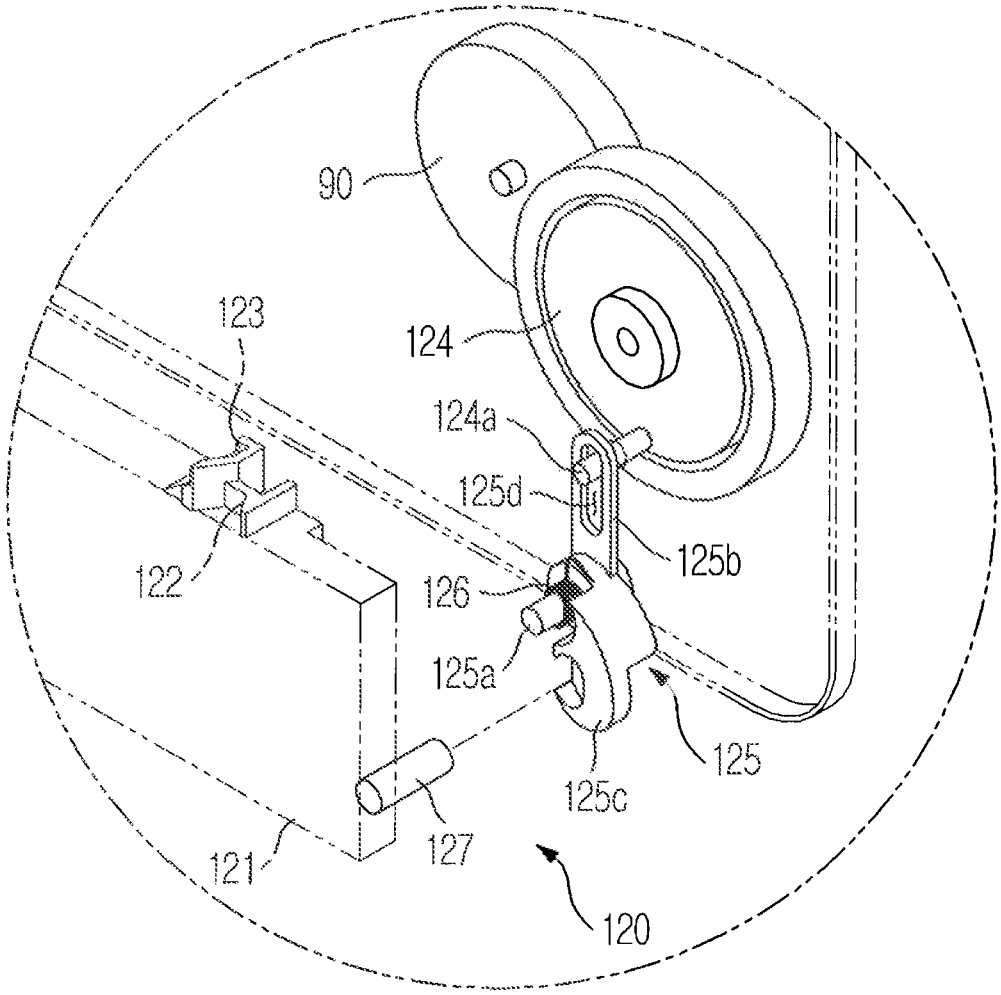
FIG. 4 is a view illustrating a drive device to operate a drive plate according to an exemplary embodiment of the present general inventive concept.
Figure 5:
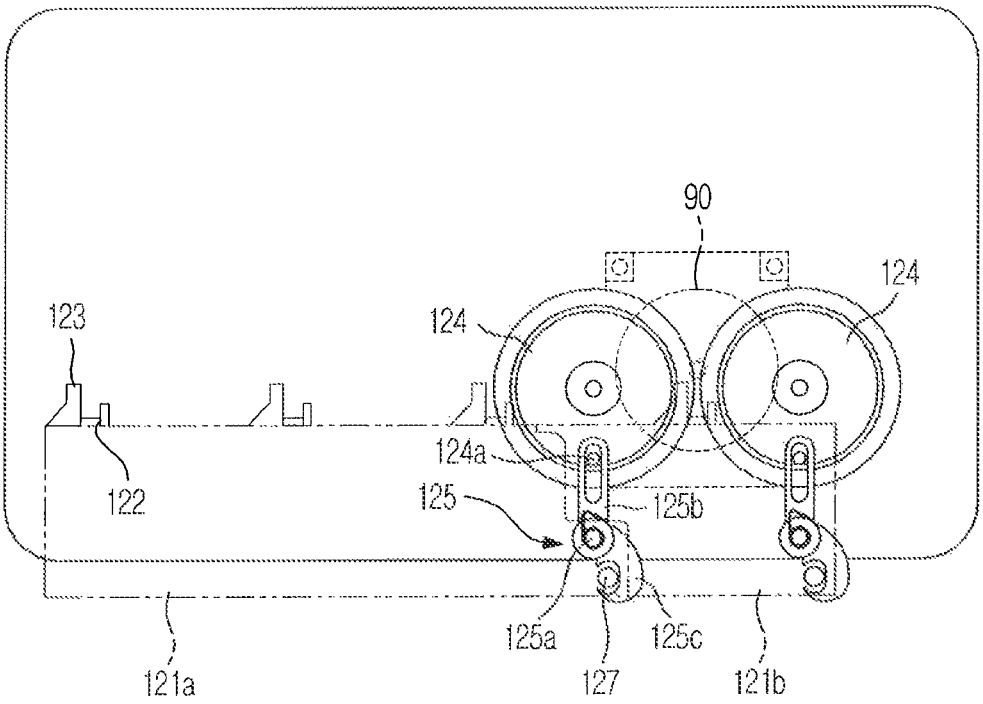
FIGS. 5 and 6 are views illustrating an operational relationship between the drive device and the drive plate according to an exemplary embodiment of the present general inventive concept.

FIG. 4 is a view illustrating the drive device to operate the drive plate according to an exemplary embodiment of the present general inventive concept, and FIGS. 5 and 6 are views illustrating an operational relationship between the drive device and the drive plate according to the exemplary embodiment of the present general inventive concept.

Referring to FIG. 4, the drive device 120 according to the exemplary embodiment of the present general inventive concept may further include a drive gear 124 and a power converter 125. The drive gear 124 is rotated upon receiving power from the drive source 90, such as a motor, installed in the main body 10. The power converter 125 converts rotational motion of the drive gear 124 into rectilinear motion of the drive plate 121.

In the exemplary embodiment of the present general inventive concept, the drive source 90 is a motor, and power of the motor is transmitted to the drive gear 124 via a power transmission gear (not shown) coupled to a rotating shaft of the motor (not shown). The drive source 90 may also provide power required to rotate the photoconductor 41.

The power converter 125 may include a rotating shaft 125*a*, a supporting arm 125*b* extending from the rotating shaft 125*a* to the drive gear 124, and an operating arm 125*c* extending from the rotating shaft 125*a* to a direction opposite to the supporting arm 125*b*.

The drive gear 124 may include a supporting rod 124*a* to support the supporting arm 125*b*. The supporting rod 124*a* is inserted into a vertically elongated slot 125*d* of the supporting arm 125*b* in a vertically movable manner.

The operating arm 125*c* is rotated about the rotating shaft 125*a* upon receiving rotational force from the drive gear 124, thereby transmitting the power of the drive source 90 to the drive plate 121. The operating arm 125*c* may be supported on a contact rod 127 protruding from the drive plate 121.

An elastic member 126 in the form of a torsion spring may be fitted on the rotating shaft 125*a* to allow the operating arm 125*c* to be easily returned from a moved position to an original position thereof.

The drive gear 124 may be equal in number to the drive plate 121. Hereinafter, operation of the drive device according to the present embodiment will be described.

As illustrated in FIG. 5, two drive gears 124 adapted to be rotated upon receiving the power from the drive source 90 may be provided to correspond to the first drive plate 121*a* and the second drive plate 121*b* respectively. The drive gears 124 may be individually operated by the corresponding drive source 90 via the corresponding power transmission mechanism (not shown), such as a coupling, gear, or clutch, In addition, each of the drive gears 124 may transmit rotational force thereof to a rotating shaft of the corresponding photoconductor 41 via a power transmission mechanism (not shown).

Initially, each contact rod 127 of the first or second drive plate 121*a* or 121*b* is supported on the operating arm 125*c* of the power converter 125.

Then, if the drive gear 124 is rotated counterclockwise by a predetermined angle to move the first drive plate 121*a* upon receiving the power of the drive source 90, as illustrated in FIG. 6, the power converter 125 is rotated clockwise about the rotating shaft 125*a* and the operating arm 125*c* of the power converter 125 presses the contact rod 125, thereby acting to push the first drive plate 121*a*.

With the above-described configuration, the drive plate 121 of the drive device 120 may be rectilinearly reciprocated upon receiving the power of the drive source 90.

Although the present embodiment describes the power converter to convert rotational motion into rectilinear motion as including the member adapted to be rotated about the rotating shaft, the power converter may be embodied by use of a conventional rack gear or any other known member.

Figure 7:
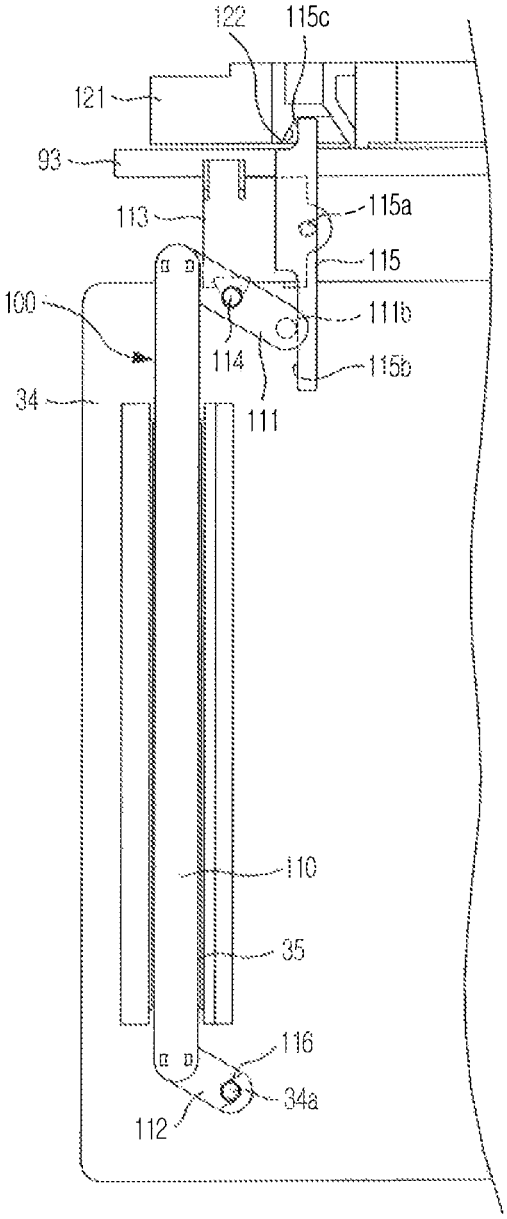
FIG. 7 is a view illustrating operation of a cleaning unit at a first position to close a transparent window according to an exemplary embodiment of the present general inventive concept.

Hereinafter, an operational relationship between the drive plate 121 and the cleaning unit 100 according to an exemplary embodiment of the present general inventive concept will be described. FIG. 7 illustrates operation of the cleaning unit at a first position to cover the transparent window according to the exemplary embodiment of the present general inventive concept, and FIG. 8 illustrates operation of the cleaning unit at a second position to open the transparent window according to the exemplary embodiment of the present general inventive concept.

As illustrated in FIG. 7, when the developing unit 40 is not in operation, the cleaning cover 110 is at a first position where it is placed on the transparent window 35 to cover the transparent window 35.

Figure 8:
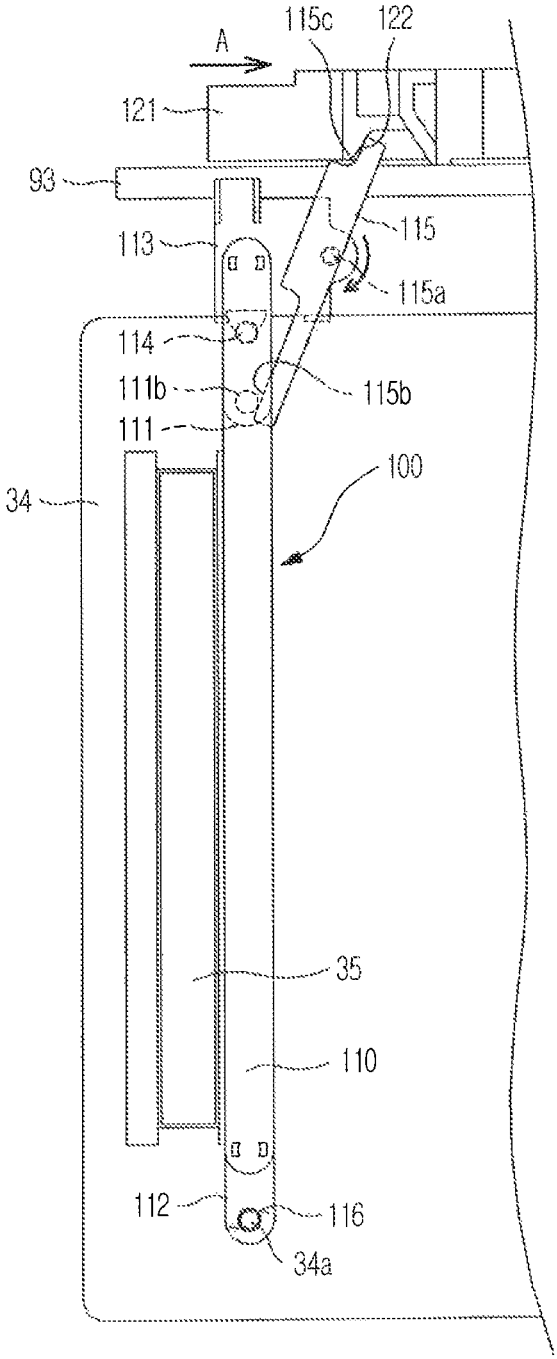
FIG. 8 is a view illustrating operation of the cleaning unit at a second position to open the transparent window according to an exemplary embodiment of the present general inventive concept.

Thereafter, as illustrated in FIG. 8, if the drive plate 121 is rectilinearly moved in a direction designated by the arrow A by the drive source 90, such as a motor, the cleaning actuator 115 is rotated clockwise about the shaft 115*a* in linkage with operation of the drive plate 121.

Thereby, as the cleaning actuator 115 presses the first link 111, the first link 111 and the second link 112 are rotated, causing the cleaning cover 110 supported by the first link 111 and the second link 112 to be moved to a second position to uncover the transparent window 35.

In the meantime, a cleaning sheet 130 may be attached to the cleaning cover 110 (see FIG. 3) so as to conic into contact with the transparent window 35 upon the covering or uncovering of the transparent window 35. The cleaning sheet 130 may take the form of a cotton flannel sheet or a brush to remove impurities adhered to the transparent window 35 when the cleaning cover 110 is moved between the first position and the second position. The cleaning sheet 130 may clean the transparent window 35 by sliding across the transparent window 35 when moving between the first position and the second position. The length of the cleaning sheet 130 may be similar to the length of the transparent window 35.

Movement of the cleaning cover 110 between the first position and the second position for covering/uncovering and cleaning of the transparent window 35 according to the present exemplary embodiment may be linked to operation of the developing unit 40 corresponding to each transparent window 35.

Figure 9:
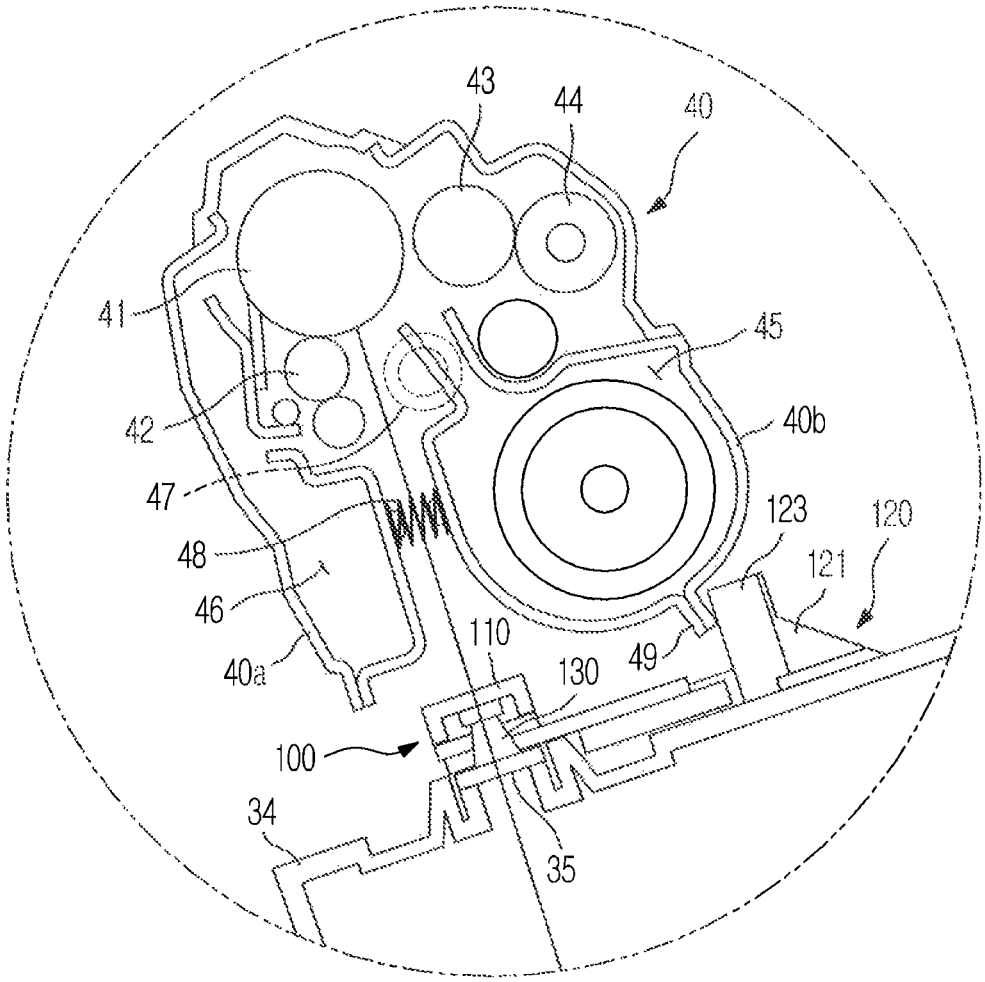
FIG. 9 is a view illustrating an operational relationship between a photoconductor and a developing roller in a state in which a cleaning cover closes the transparent window according to an exemplary embodiment of the present general inventive concept.
Figure 10:
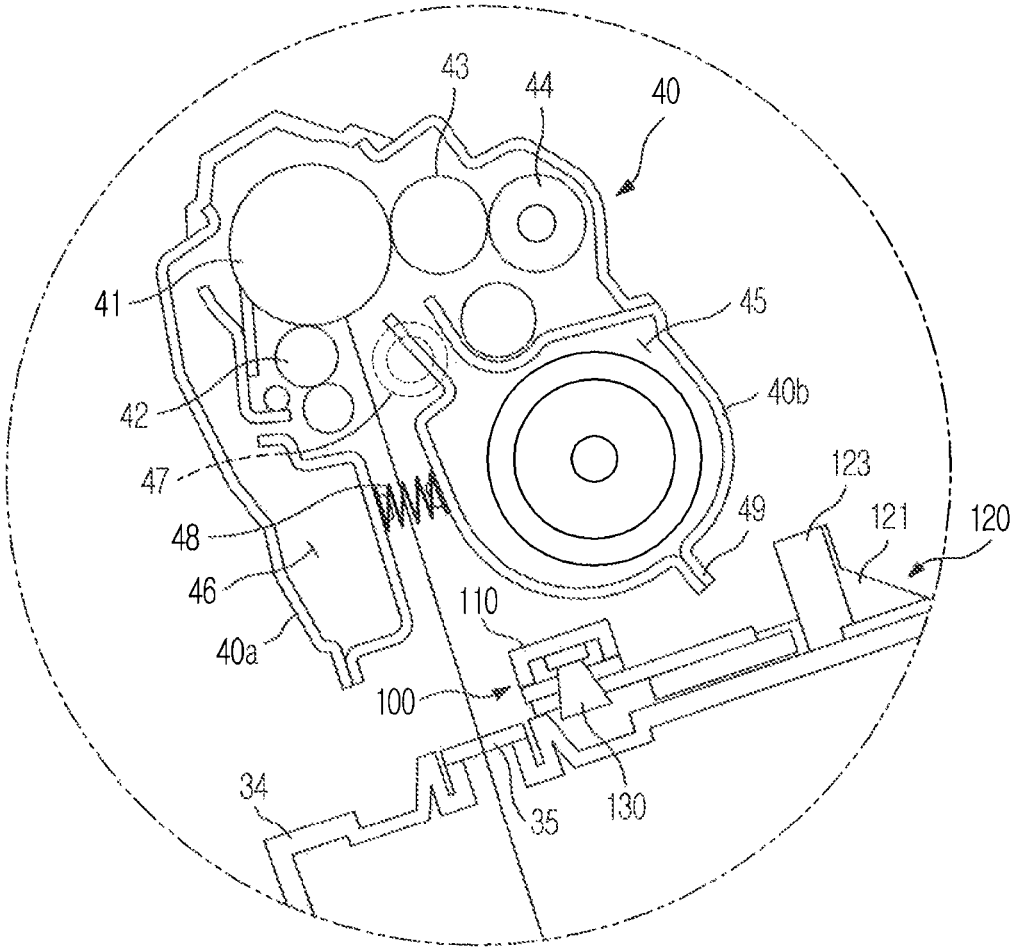
FIG. 10 is a view illustrating an operational relationship between the photoconductor and the developing roller in a state in which the cleaning cover opens the transparent window according to an exemplary embodiment of the present general inventive concept.

FIGS. 9 and 10 illustrate an operational relationship between the developing unit 40 and the cleaning cover 110 according to an exemplary embodiment of the present general inventive concept. FIG. 9 illustrates an operational relationship between the photoconductor 41 and the developing roller 43 in a state in which the cleaning cover 110 covers the transparent window 35, and FIG. 10 illustrates an operational relationship between the photoconductor 41 and the developing roller 43 in a state in which the cleaning cover 110 uncovers the transparent window 35.

Referring to FIGS. 9 and 10, the developing unit 40 of the present exemplary embodiment may include a first housing 40*a* to support the photoconductor 41, and a second housing 40*b* to support the developing roller 43.

The first housing 40*a* may define a waste developer reservoir 46 therein and may support the charging roller 42 and the photoconductor 41. The second housing 40*b* may define a developer reservoir 45 therein and may support the feed roller 44 and the developing roller 43.

The first housing 40*a* and the second housing 40*b* are rotatably coupled to each other via a rotating shaft 47 and are elastically supported by an elastic member 48 interposed therebetween.

The elastic member 48 may be a compressive coil spring to press the first housing 40*a* and the second housing 40*b*.

The photoconductor 41 and the developing roller 43, supported respectively by the first and second housings 40*a* and 40*b*, may be movable between a first position where they are spaced apart from each other (see FIG. 9) and a second position where they come into contact with each other (see FIG. 10).

The first and second housings 40*a* and 40*b* are pressed to come into contact with each other by the elastic member 48 until external force is applied thereto, On the other hand, if external force is applied thereto, the first and second housings 40*a* and 40*b* are rotated about the rotating shaft 47, causing the photoconductor 41 and the developing roller 43 to be moved away from each other.

Power to cause the photoconductor 41 and the developing roller 43 to come into contact or be moved away from each other may be provided by the drive plate 121 of the drive device 120 that serves to move the cleaning cover 110.

To this end, the developing unit 40 may be provided with a retainer protrusion 49 to receive power transmitted from the drive plate 121, and the drive plate 121 may be provided with a pressure protrusion 123 to interfere with the retainer protrusion 49 during movement thereof.

The retainer protrusion 49 may extend outward from a bottom position of the second housing 40*b*, and the pressure protrusion 123 may protrude upward from an upper surface of the drive plate 121.

With the above-described configuration, the drive device 120 may simultaneously operate the developing unit 40 and the cleaning unit 100.

Specifically, as illustrated in FIGS. 7 and 9, while the image forming apparatus stops printing operation, the drive plate 121 presses the retainer protrusion 49 of the developing unit 40 and thus, the second housing 40*b* remains rotated about the rotating shaft 47 such that the photoconductor 41 and the developing roller 43 are spaced apart from each other.

In this case, the transparent window 35, through which light is transmitted to the photoconductor 41 of the developing unit 40, is kept covered by the cleaning cover 110.

Thereafter, if the image forming apparatus performs printing operation, as illustrated in FIGS. 8 and 10, the drive plate 121 slides in the direction A upon receiving power from the drive source 90 (see FIG. 8).

In this case, the pressure protrusion 123 of the drive plate 121 is released from the retainer protrusion 49 of the developing unit 40 and thus, the developing unit 40 is rotated about the rotating shaft 47 by elasticity of the elastic member 48, causing the photoconductor 41 and the developing roller 43 to come into contact with each other while defining a developing nip therebewteen.

Simultaneously, the drive plate 121 rotates the cleaning actuator 115 coming into contact with the actuator nip 122 thereof.

Thereby, as the cleaning cover 110 is moved to a position to open the transparent window 35, light emitted from the light source of the light scanning unit 30 is transmitted to the photoconductor 41 through the transparent window 35.

In this way, the cleaning unit 110 uncovers the transparent window 35 only during printing operation and closes the transparent window 35 during stoppage of printing operation.

Accordingly, since the transparent window 35 is not exposed during stoppage of printing operation, the transparent window 35 may be less stained with impurities. Moreover, impurities adhered to the transparent window 35 may be removed whenever printing operation is performed, which results in remarkably enhanced cleaning performance.

That is, in linkage with the photoconductor 41 and the developing roller 43 being moved away from each other or being brought into contact with each other to perform printing operation, the cleaning cover 110 of the cleaning unit 100 is reciprocated between a position to uncover the transparent window 35 and a position to cover the transparent window 35, the number of operations of cleaning the transparent window 35 is increased.

In addition, even if a plurality of developing units 40 are provided, the cleaning unit 100 of the present general inventive concept may uncover and clean only the transparent window 35 corresponding to a selected one of the developing units 40, which remarkably reduces the chance of adherence of impurities to the remaining transparent windows 35 that are not in use.

The scope of the present general inventive concept is not limited to the above description and may include the following exemplary embodiments.

In another exemplary embodiment, differently from the above described exemplary embodiment in which the cleaning actuator 115 is operated in linkage with operation of the drive plate 121, the cleaning actuator 115 may be operated in linkage with operation of the housings 40*a* and 40*b* of the developing unit 40.

In another exemplary embodiment, if the photoconductor 41 and the developing roller 43 are brought into contact with each other or are moved away from each other by any other drive device, the cleaning unit 100 may be operated in linkage with operation of the drive device.

Specifically, provided that the cleaning unit 100 is operated to cover or uncover the transparent window 35 of the light scanning unit 30 in linkage with a drive device that serves to move the photoconductor 41 and the developing roller 43 toward or away from each other, configurations of constituent elements of the drive device are not limited to the above description.

As is apparent from the above description, an image forming apparatus according to the present general inventive concept may allow a transparent window of a light scanning unit to be uncovered only during printing operation, thereby achieving enhanced operation stability. Further, cleaning the transparent window whenever a printing operation is performed may result in efficient removal of impurities adhered to the transparent window.

Although a few exemplary embodiments of the present general inventive concept have been illustrated and described, it would be appreciated by those skilled in the art that changes may be made in these exemplary embodiments without departing from the principles and spirit of the general inventive concept, the scope of which is defined in the claims and their equivalents.

What is claimed is:

1. An image forming apparatus to form an image, comprising:

a process cartridge including a photoconductor and a developing roller movably installed between a first position to come into contact with the photoconductor and a second position to be spaced apart from the photoconductor;

a light scanning unit including a light source and a transparent window through which light emitted from the light source is transmitted;

a cleaning unit including a cleaning cover movably installed to uncover and cover the transparent window in linkage with movement of the developing roller between the first position and the second position; and a drive device including a drive plate to be rectilinearly reciprocated by a drive source to actuate the process cartridge and the cleaning unit, the drive plate being separated from the process cartridge and in contact with the cleaning unit at the first position and in contact with the process cartridge at the second position.

2. The apparatus according to claim 1, wherein the cleaning cover uncovers the transparent window when the developing roller is at the first position and covers the transparent window when the developing roller is at the second position.

3. The apparatus according to claim 2, wherein the drive device moves the developing roller, and wherein the cleaning cover is operated in linkage with the drive device.

4. The apparatus according to claim 3, wherein:

during movement of the drive plate, the developing roller and the cleaning cover are operated in linkage with operation of the drive plate.

5. The apparatus according to claim 1, wherein a cleaning sheet to clean the transparent window is attached to the cleaning cover.

6. The apparatus according to claim 4, wherein the drive device further includes a drive gear to be rotated upon receiving power from the drive source, and a power converter to convert rotational motion of the drive gear to rectilinear motion of the drive plate.

7. The apparatus according to claim 6, wherein the power converter includes a rotating shaft, a supporting arm extending in a given direction from the rotating shaft so as to receive rotational force of the drive gear, and an operating arm extending in an opposite direction from the rotating shaft so as to press the drive plate.

8. The apparatus according to claim 7, wherein the power converter further includes a torsion spring fitted on the rotating shaft so as to return the operating arm to an original position.

9. The apparatus according to claim 4, wherein the cleaning unit includes a first link having one end rotatably coupled to a first end of the cleaning cover and a second link having one end rotatably coupled to a second end of the cleaning cover, and a cleaning plate to which a center portion of the first link is rotatably coupled.

10. The apparatus according to claim 9, wherein the cleaning unit further includes a cleaning actuator rotatably coupled to the cleaning plate so as to rotate the first link in linkage with operation of the drive plate.

11. The apparatus according to claim 6, wherein the process cartridge includes a first housing to support the photoconductor, a second housing to support the developing roller, a rotating shaft to rotatably couple the first and second housings to each other so as to enable movement of the developing roller between the first position and the second position, and an elastic member to elastically support the first and second housings so as to bias the developing roller to the first position.

12. The apparatus according to claim 11, wherein the process cartridge further includes a retainer protrusion configured to contact the drive plate to move the developing roller to the second position in linkage with operation of the drive plate.

13. The apparatus according to claim 12, wherein the drive plate includes a pressure protrusion to press the retainer protrusion.

14. The apparatus according to claim 1, wherein:

the process cartridge includes first to fourth process cartridges in which magenta, cyan, yellow and black toners are received respectively;

the light scanning unit includes first to fourth transparent windows through which light is transmitted toward the photoconductor of each of the first to fourth process cartridges; and the cleaning cover includes first to fourth cleaning covers to uncover and cover the first to fourth transparent windows respectively.

15. The apparatus according to claim 14, wherein the first to fourth cleaning covers are individually operated according to operation of each developing roller that feeds toner to the photoconductor of each of the first to fourth process cartridges.

16. The apparatus according to claim 14, wherein the fourth cleaning cover to uncover and cover the fourth transparent window is movable independently of the first to third cleaning covers.

17. The apparatus according to claim 16, wherein the drive plate comprises:

a first drive plate to move the first to third cleaning covers; and a second drive plate to move the fourth cleaning cover.

18. The apparatus according to claim 1, wherein:

the process cartridge includes a first housing to support the photoconductor and a second housing to support the developing roller;

the first housing and the second housing are rotatably coupled to each other;

the drive device presses and rotates the second housing so as to move the developing roller; and the cleaning cover is installed to uncover and cover the transparent window in linkage with rotation of the second housing.

19. The apparatus according to claim 18, wherein the cleaning unit further includes a first link having one end rotatably coupled to a first end of the cleaning cover and a second link having one end rotatably coupled to a second end of the cleaning cover, a cleaning plate to which a center portion of the first link is rotatably coupled, and a cleaning actuator rotatably coupled to the cleaning plate so as to rotate the first link in linkage with rotation of the second housing, one end of the cleaning actuator being supported by the first link and the other end being supported by the second housing.

20. An image forming apparatus to form an image, comprising:

at least one process cartridge including a photoconductor, a developing roller to feed toner to the photoconductor so as to form a visible image, a first housing to support the photoconductor, a second housing to support the developing roller, a rotating shaft to rotatably couple the first housing and the second housing to each other such that the photoconductor and the developing roller are rotatable between a position in contact with each other and a position spaced apart from each other, and an elastic member to apply elastic force to bias the photoconductor and the developing roller into the position in contact with each other;

a drive device to be reciprocated between a position to press at least one of the first and second housings and a position not pressing the first and second housings; and a cleaning unit including a housing having at least one transparent window through which light emitted from a light source received in the housing is transmitted to the photoconductor, and at least one cleaning cover movably installed between a first position to uncover the transparent window and a second position to cover the transparent window, wherein the cleaning cover is movably installed between the first position and the second position in linkage with reciprocation of the drive device, and wherein the drive device includes a drive plate to be rectilinearly reciprocated by a drive source to actuate the process cartridge and the cleaning unit, the drive plate being separated from the process cartridge and in contact with the cleaning unit at the first position and in contact with the process cartridge at the second position.

21. The apparatus according to claim 20, wherein a cleaning sheet is attached to the cleaning cover to clean the transparent window.

22. The apparatus according to claim 20, wherein the cleaning cover uncovers the transparent window when the photoconductor and the developing roller come into contact with each other, and covers the transparent window when the photoconductor and the developing roller are spaced apart from each other.

23. The apparatus according to claim 20, wherein:

the cleaning unit includes a cleaning actuator to be rotated upon receiving power of the drive plate so as to move the cleaning cover.

24. The apparatus according to claim 23, wherein at least one of the first and second housings is provided with a retainer protrusion, which comes into contact with the drive plate when the drive plate is moved in a first direction, thereby acting to rotate at least one of the first and second housings upon receiving power of the drive plate, and is released from the drive plate when the drive plate is moved in a second direction opposite to the first direction.

25. The apparatus according to claim 24, wherein the drive plate is provided with a pressure protrusion to be caught and supported by the retainer protrusion when the drive plate is moved in the first direction.

26. The apparatus according to claim 23, wherein the drive device further includes a drive gear to be rotated upon receiving power from the drive source, and a power converter to convert rotational motion of the drive gear to rectilinear motion of the drive plate.

27. The apparatus according to claim 26, wherein the power converter includes a rotating shaft, a supporting arm extending in a given direction from the rotating shaft so as to receive rotational force of the drive gear, and an operating arm extending in an opposite direction from the rotating shaft so as to press the drive plate.

28. The apparatus according to claim 27, wherein the power converter further includes a torsion spring fitted on the rotating shaft so as to return the operating arm to an original position.

29. The apparatus according to claim 23, wherein the cleaning unit includes a cleaning plate to which a center portion of the cleaning actuator is rotatably coupled, a first link having one end supported by the housing and the other end supported by a first end of the cleaning cover, and a second link centrally rotatably coupled to the cleaning plate, one end of the second link being supported by a second end of the cleaning cover and the other end of the second link being supported by the cleaning actuator.

30. The apparatus according to claim 23, wherein:

the at least one process cartridge includes a plurality of process cartridges each including a corresponding photoconductor and a corresponding developing roller;

the at least one transparent window includes a plurality of transparent windows provided at the housing to correspond to the photoconductor of each of the plurality of process cartridges;

the at least one cleaning cover includes a plurality of cleaning covers corresponding to the plurality of transparent windows respectively; and the drive plate includes a first drive plate to move any one of the plurality of cleaning covers and a second drive plate to move the others of the plurality of cleaning covers.

31. The apparatus according to claim 23, wherein:

the at least one process cartridge includes a plurality of process cartridges each including a corresponding photoconductor and a corresponding developing roller;

the at least one transparent window includes a plurality of transparent windows provided at the housing to correspond to the photoconductor of each of the plurality of process cartridges;

the at least one cleaning cover includes a plurality of cleaning covers corresponding to the plurality of transparent windows respectively; and each of the plurality of cleaning covers uncovers or covers one corresponding transparent window in linkage with an operation to cause the developing roller and the photoconductor to rotate between the position in contact with each other or the position spaced apart from each other.

32. An image forming apparatus to form an image, comprising:

a process cartridge including a photoconductor and a developing roller to feed toner to the photoconductor so as to form a visible image, a first housing to support the photoconductor, a second housing to support the developing roller, a rotating shaft to rotatably couple the first housing and the second housing to each other such that the photoconductor and the developing roller are rotatable between a position in contact with each other and a position spaced apart from each other, and an elastic member to apply elastic force to bias the photoconductor and the developing roller to the position in contact with each other;

a drive device to press the second housing so as to rotate the second housing about the rotating shaft; and a cleaning unit including a housing having a transparent window through which light emitted from a light source received in the housing is transmitted to the photoconductor, and a cleaning cover movably installed between a first position to uncover the transparent window and a second position to cover the transparent window, wherein the cleaning cover is movably installed between the first position and the second position in linkage with rotation of the second housing, and wherein the drive device includes a drive plate to be rectilinearly reciprocated by a drive source to actuate the process cartridge and the cleaning unit, the drive plate being separated from the process cartridge and in contact with the cleaning unit at the first position and in contact with the process cartridge at the second position.

33. The apparatus according to claim 32, wherein the cleaning unit further includes a first link having one end rotatably coupled to a first end of the cleaning cover and a second link having one end rotatably coupled a second end of the cleaning cover, a cleaning plate to which a center portion of the first link is rotatably coupled, and a cleaning actuator rotatably coupled to the cleaning plate so as to rotate the first link in linkage with rotation of the second housing, one end of the cleaning actuator being supported by the first link and the other end being supported by the second housing.

34. An image forming apparatus to form an image, comprising:

a process cartridge including a photoconductor and a developing roller;

a light scanning unit including a light source and a transparent window through which light emitted from the light source is transmitted to the photoconductor;

a cleaning unit including a cleaning cover moveable between a first position to cover the transparent window and a second position to uncover the transparent window, wherein the cleaning cover includes a cleaning sheet attached to the cleaning cover such that the cleaning sheet slides across the transparent window to clean the transparent window when the cleaning cover moves from the first position to the second position; and a drive device including a drive plate to be rectilinearly reciprocated by a drive source to actuate the process cartridge and the cleaning unit, the drive plate being separated from the process cartridge and in contact with the cleaning unit at the first position and in contact with the process cartridge at the second position.

35. The apparatus according to claim 34, wherein the cleaning sheet comprises a cotton flannel sheet.

36. The apparatus according to claim 34, wherein the cleaning sheet comprises a brush.

37. The apparatus according to claim 34, wherein a length of the cleaning sheet is substantially equal to the length of the transparent window.

* * * * *